US007628472B2

(12) United States Patent
Tomizawa et al.

(10) Patent No.: US 7,628,472 B2
(45) Date of Patent: Dec. 8, 2009

(54) INK-JET RECORDING HEAD

(75) Inventors: Keiji Tomizawa, Kanagawa (JP); Shuichi Murakami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 142 days.

(21) Appl. No.: 10/747,204

(22) Filed: Dec. 30, 2003

(65) Prior Publication Data

US 2004/0218007 A1 Nov. 4, 2004

(30) Foreign Application Priority Data

Jan. 10, 2003 (JP) ..... 2003-004306
Dec. 24, 2003 (JP) ..... 2003-427054

(51) Int. Cl.
*B41J 2/05* (2006.01)
*B41J 2/15* (2006.01)

(52) U.S. Cl. ..... 347/65; 347/40; 347/56; 347/61

(58) Field of Classification Search ..... 347/65, 347/40, 56, 61
See application file for complete search history.

(56) References Cited

U.S. PATENT DOCUMENTS

| | | | | |
|---|---|---|---|---|
| 5,218,376 | A | 6/1993 | Asai | |
| 5,455,613 | A * | 10/1995 | Canfield et al. | 347/65 |
| 5,646,662 | A | 7/1997 | Kitahara | |
| 5,825,385 | A | 10/1998 | Silverbook | |
| 5,900,894 | A * | 5/1999 | Koizumi et al. | 347/65 |
| 6,113,221 | A * | 9/2000 | Weber | 347/61 |
| 6,520,626 | B1 | 2/2003 | Murakami | |
| 6,557,974 | B1 | 5/2003 | Weber | |
| 6,942,318 | B2 * | 9/2005 | Fartash | 347/65 |
| 2002/0039127 | A1 * | 4/2002 | Shin et al. | 347/65 |
| 2002/0196301 | A1 * | 12/2002 | Murakami et al. | 347/15 |
| 2003/0016270 | A1 | 1/2003 | Kubota et al. | |

(Continued)

FOREIGN PATENT DOCUMENTS

| | | |
|---|---|---|
| EP | 0 465 071 | 1/1992 |

(Continued)

OTHER PUBLICATIONS

WO 02/14073 Torgenson et al. (Feb. 21, 2002).*

*Primary Examiner*—Matthew Luu
*Assistant Examiner*—Jannelle M Lebron
(74) *Attorney, Agent, or Firm*—Fitzpatrick, Cella, Harper & Scinto

(57) ABSTRACT

An ink-jet recording head includes a discharge-port portion including a first discharge-port portion continuing from a discharge port, and a second discharge-port portion communicating the first discharge-port portion with a bubble generation chamber. The second discharge-port portion has an end surface that includes a border portion bordering the first discharge-port portion and is parallel to a main surface of an element substrate. The cross-sectional area of the second discharge-port portion, anywhere from an opening surface facing the bubble generation chamber to an end surface facing the first discharge-port portion, that is parallel to the main surface of the element substrate, is larger than the area of the border portion. The cross section of the opening surface of the second discharge-port portion has a length in a direction perpendicular to an arrangement direction of the discharge ports that is greater than its length in a direction parallel to the arrangement direction.

4 Claims, 10 Drawing Sheets

U.S. PATENT DOCUMENTS

2003/0058305 A1 3/2003 Murakami et al.

FOREIGN PATENT DOCUMENTS

| | | | |
|---|---|---|---|
| EP | 465071 | A2 * | 1/1992 |
| EP | 0 867 292 | | 9/1998 |
| EP | 1 193 068 | | 4/2002 |
| JP | 54-161935 | | 12/1979 |
| JP | 61-185455 | | 8/1986 |
| JP | 61-249768 | | 11/1986 |
| JP | 62-194045 | | 12/1987 |
| JP | 1-74142 | | 5/1989 |
| JP | 4-10940 | | 1/1992 |
| JP | 4-10941 | | 1/1992 |
| JP | 4-232752 | | 8/1992 |
| JP | 5-84909 | | 4/1993 |
| JP | 5-116317 | | 5/1993 |
| JP | 5-177834 | | 7/1993 |
| JP | 6-064171 | | 3/1994 |
| JP | 6-297711 | | 10/1994 |
| JP | 9-239986 | | 9/1997 |
| JP | 09-327921 | | 12/1997 |
| JP | 10-501766 | | 2/1998 |
| JP | 2000-334965 | | 12/2000 |
| JP | 2001-277499 | | 10/2001 |
| WO | WO 02/14073 | | 2/2002 |

* cited by examiner 6C
6C
6B
6B
FIRST DISCHARGE-PORT PORTION
4
1
HEATER

FIRST DISCHARGE-PORT PORTION
4
SECOND DISCHARGE-PORT PORTION
10
SUPPLY CHANNEL
9
6
SUPPLY CHAMBER
11
BUBBLE GENERATION CHAMBER
1
HEATER
12
SUB-SUPPLY CHANNEL

FIRST DISCHARGE-PORT PORTION
4
SECOND DISCHARGE-PORT PORTION
10
11
BUBBLE GENERATION CHAMBER
1
HEATER

INK-JET RECORDING HEAD

BACKGROUND OF THE INVENTION

1. Field of the Invention

The present invention relates to a liquid-discharge head for performing recording on a recording medium by discharging droplets of a liquid, such as ink, or the like. More particularly, the invention relates to a liquid discharge head for performing ink-jet recording.

2. Description of the Related Art

An ink-jet recording method is one of so-called non-impact recording methods. In the ink-jet recording method, noise generated during recording is negligibly small, and high-speed recording can be performed. Furthermore, recording can be performed on various recording media. For example, on so-called ordinary paper, ink is fixed without requiring particular processing, and a very precise image can be inexpensively obtained. Because of such features, the ink-jet recording method has been rapidly spreading recently not only for printers, serving as peripheral apparatuses of computers, but also as recording means for copiers, facsimile apparatuses, word processors, and the like.

Generally utilized ink discharge methods of the ink-jet recording method include a method of using electrothermal transducers, such as heaters or the like, as discharge-energy generation elements used for discharging ink droplets, and a method of using piezoelectric elements. Each of these methods can control discharge of ink droplets by an electric signal. The principle of the ink discharge method using electrothermal transducers consists in causing ink near an electrothermal transducer to instantaneously boil by applying a voltage to the electrothermal transducer, and discharging an ink droplet at a high speed by an abrupt bubble pressure generated by a phase change of ink at boiling. The method of discharging ink using piezoelectric elements consists in discharging ink droplets by a pressure generated during displacement of a piezoelectric element caused by application of a voltage to the piezoelectric element.

The ink discharge method using electrothermal transducers has, for example, the features that it is unnecessary to provide a large space for disposing discharge-energy generation elements, the structure of a recording head is simple, and nozzles can be easily integrated. However, this method has, for example, the peculiar problems that the volume of ink droplets to be ejected changes due to storage of heat generated by the electrothermal transducers within the recording head, cavitation produced by disappearance of bubbles adversely influences the electrothermal transducers, and the discharge characteristics of ink droplets and the image quality are adversely influenced by bubbles of air dissolved within the ink that remains within the recording head.

In order to solve these problems, Japanese Patent Application Laid-Open (Kokai) Nos. 54-161935 (1979), 61-185455 (1986), 61-249768 (1986) and 4-10941 (1992) disclose ink-jet recording methods and recording heads. In the ink-jet recording methods that have been disclosed in the above-described publications, a bubble generated by driving an electrothermal transducer is caused to communicate with external air. By adopting such ink-jet recording methods, for example, it is possible to stabilize the volume of a traveling ink droplet, discharge an ink droplet containing a very small amount of ink at a high speed, improve the durability of a heater by preventing cavitation generated during disappearance of a bubble, and easily obtain a more precise image. In the above-described publications, in order to cause a bubble to communicate with external air, a configuration is described in which the shortest distance between an electrothermal transducer for generating a bubble in ink, and a discharge port, serving as an opening for discharging ink, is greatly reduced compared with conventional configurations.

The configuration of a recording head of this type will now be described. The configuration includes an element substrate on which electrothermal transducers for discharging ink are provided, and a channel-configuration substrate (also termed an "orifice substrate") for providing ink channels by being connected to the element substrate. The channel-configuration substrate includes a plurality of nozzles where ink flows, a supply chamber for supplying these nozzles with ink, and a plurality of discharge ports, serving as nozzle-distal-end openings for discharging ink droplets. The nozzle includes a bubble generation chamber for generating a bubble by a corresponding one of the electrothermal transducers, and a supply channel for supplying the bubble generation chamber with ink. The element substrate includes the electrothermal transducers at positions corresponding to the bubble generation chambers. The element substrate also includes a supply port for supplying the supply chamber with ink from a back surface opposite to a main surface contacting the channel-configuration substrate. The channel-configuration substrate includes discharge ports at positions facing corresponding ones of the electrothermal transducers on the element substrate.

In the recording head having the above-described configuration, ink supplied from the supply port into the supply chamber is supplied along each of the nozzles, and is filled within the bubble generation chamber. The ink filled within the bubble generation chamber is caused to travel in a direction substantially orthogonal to the main surface of the element substrate by a bubble generated by film boiling by the electrothermal transducer, and is discharged from the discharge port as an ink droplet (a head of this type is hereinafter termed a "side-shooter-type ink-jet head").

In such a side-shooter-type ink-jet head, when discharging an ink droplet, ink filled within the bubble generation chamber travels separately toward the discharge port side and the supply channel side due to a bubble generated within the bubble generation chamber. At that time, part of the pressure due to bubble generation in the ink is applied toward the supply channel side, or a pressure loss is generated due to friction with the inner wall of the discharge port. This phenomenon adversely influences ink discharge, and is more pronounced as the amount of ink contained in the discharged ink droplet is smaller (i.e., as the volume of the discharged droplet is smaller). That is, when the discharge diameter is reduced in order to reduce the volume of the discharged ink droplet, the fluid resistance of the discharge port greatly increases to reduce the flow rate toward the discharge port and increase the flow rate toward the supply channel, thereby reducing the discharge speed of the ink droplet.

SUMMARY OF THE INVENTION

It is an object of the present invention to solve the above-described problems.

According to one aspect of the present invention, an ink-jet recording head includes a channel-configuration substrate including a plurality of discharge ports for discharging a liquid, a plurality of bubble generation chambers for generating bubbles utilized for discharging the liquid by thermal energy generated by electrothermal transducers, a plurality of discharge-port portions for causing the discharge ports to communicate with the bubble generation chambers, and at least one supply channel for supplying the discharge-port portions and the bubble generation chambers with the liquid, and an element substrate on which the electrothermal transducers are provided, and to a main surface of which the channel-configuration substrate is connected. Each of the discharge-port portions includes a first discharge-port portion continuing from the corresponding discharge port, and a second discharge-port portion for causing the first discharge-port portion to communicate with the corresponding bubble generation chamber. The second discharge-port portion has an end surface that includes a border portion bordering the first discharge-port portion and is parallel to the main surface of the element substrate. Any cross section of the second discharge-port portion, from an opening surface facing the bubble generation chamber to the end surface facing the first discharge-port portion, that is parallel to the main surface of the element substrate, has an area that is larger than an area of the border portion. A cross section of the opening surface of the second discharge-port portion facing the bubble generation chamber that is parallel to the main surface of the element substrate has a shape such that a length thereof in a direction perpendicular to a direction of arrangement of the discharge ports is larger than a length thereof in a direction parallel to the direction of arrangement of the discharge ports.

According to another aspect of the present invention, an ink-jet recording head includes a channel-configuration substrate including a plurality of discharge ports for discharging a liquid, a plurality of pressure chambers for generating pressures utilized for discharging the liquid by discharge-energy generation elements, a plurality of discharge-port portions for causing the discharge ports to communicate with the pressure chambers, and at least one supply channel for supplying the discharge-port portions and the pressure chambers with the liquid, and an element substrate on which the discharge-energy generation elements are provided, and to a main surface of which the channel-configuration substrate is connected. Each of the discharge-port portions includes a first discharge-port portion continuing from the corresponding discharge port, and a second discharge-port portion for causing the first discharge-port portion to communicate with the corresponding pressure chamber. The second discharge-port portion has an end surface that includes a border portion bordering the first discharge-port portion and is parallel to the main surface of the element substrate. Any cross section of the second discharge-port portion, from an opening surface facing the pressure chamber to the end surface facing the first discharge-port portion, that is parallel to the main surface of the element substrate, has an area that is larger than an area of the border portion. A cross section of the opening surface of the second discharge-port portion facing the pressure chamber that is parallel to the main surface of the element substrate has a shape such that a length thereof in a direction perpendicular to a direction of arrangement of the discharge ports is larger than a length thereof in a direction parallel to the direction of arrangement of the discharge ports. A cross section of the second discharge-port portion at the end surface facing the first discharge-port portion has a shape such that a ratio of a length of the second discharge-port portion to a length of the first discharge-port portion in the direction perpendicular to the direction of arrangement of the discharge ports is larger than a ratio of a length of the second discharge-port portion to a length of the first discharge-port portion in the direction parallel to the direction of arrangement of the discharge ports.

According to the above-described configuration, the pressure loss in the flow of the liquid toward the discharge ports can be minimized. As a result, even if the fluid resistance in the direction of the discharge ports at the first discharge-port portion is increased by further reducing the size of the discharge ports at the distal ends of the nozzles, it is possible to suppress the reduction of the flow rate in the direction of the discharge ports when discharging the liquid, and thereby prevent reduction of the discharge speed of the liquid droplets. In the above-described configuration, it is possible to increase the volume of the second discharge-port portion without hindering a high-density arrangement of the discharge ports. Accordingly, it is possible to realize a high-density arrangement of the discharge ports while suppressing reduction of the discharge speed, and thereby provide a very precise recorded image.

An ink discharge method in which the bubble generated by the discharge-energy generation element communicates with external air is suitably applied to the ink-jet recording head of the present invention.

The foregoing and other objects, advantages and features of the present invention will become more apparent from the following description of the preferred embodiments taken in conjunction with the accompanying drawings.

DESCRIPTION OF THE PREFERRED EMODIMENTS

Preferred embodiments of the present invention will now be described with reference to the drawings.

An ink-jet recording head according to the present invention adopts a method, from among various ink-jet recording methods, in which means for generating thermal energy utilized for discharging ink in the form of a liquid is provided, and a change in the state of the ink is caused to occur by thermal energy. By adopting this method, characters, images and the like are recorded very precisely at a high density. In the present invention, an electrothermal transducer is used as means for generating thermal energy, and ink is discharged utilizing a pressure due to a bubble generated when ink is subjected to film boiling by being heated First, the entire configuration of the ink-jet recording head of the invention will be described.

Figure 1:
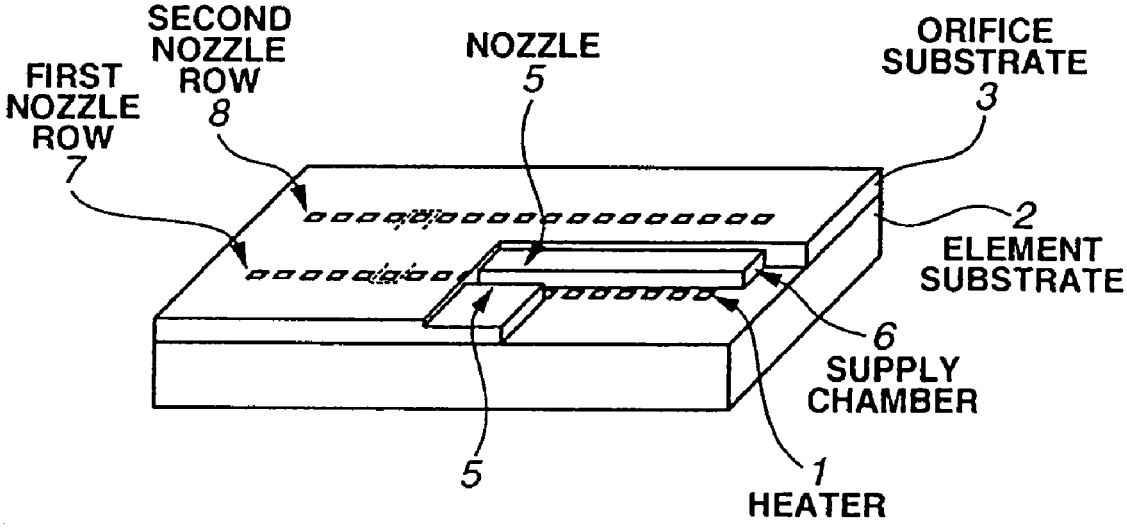
FIG. 1 is a partly broken perspective view illustrating an ink-jet recording head according to the present invention.

FIG. 1 is a partly broken perspective view illustrating the ink-jet recording head of the invention.

In the ink-jet recording head shown in FIG. 1, a partition wall for individually forming nozzles 5, each serving as an ink channel, for a plurality of heaters 1, each serving as an electrothermal transducer, is extended from a first discharge-port portion 4 to a portion near a supply chamber 6.

The ink-jet recording head has the plurality of heaters 1 and the plurality of nozzles 5, and has a first nozzle row 7 in which the longitudinal direction of each of the nozzles 5 is arranged in parallel, and a second nozzle row 8 in which the longitudinal direction of each of the nozzles 5 is arranged in parallel at a position facing the first nozzle row 7 across the supply chamber 6.

In each of the first nozzle row 7 and the second nozzle row 8, nozzles are arranged at a pitch of 600-1,200 dpi (dots per inch). The nozzles 5 of the second nozzle row 8 are arranged by being shifted by ½ pitch with respect to the nozzles 5 of the first nozzle row 7.

This recording head has ink discharge means to which an ink-jet recording method disclosed in Japanese Patent Application Laid-Open (Kokai) Nos. 4-10940 (1992) and 4-10941 (1992) is applied, and can have a structure in which a bubble generated during ink discharge is caused to communicate with external air via a discharge port.

The structure of a nozzle (discharge-port portion) of an ink-jet recording head, serving as a principle part of the present invention, will now be described.

The ink-jet recording head of the invention includes a channel-configuration substrate 3 that includes the plurality of nozzles 5 in which ink flows, the supply chamber 6 for supplying each of the nozzles 5 with ink, and the plurality of first discharge-port portions 4, each serving as a nozzle-distal-end opening for discharging an ink droplet. Each nozzle 5 includes a discharge-port portion including a first discharge-port portion 4, a bubble generation chamber 11 for generating a bubble by thermal energy generated by a heater 1, serving as an electrothermal transducer, a second discharge-port portion 10 for causing the discharge-port portion to communicate with the bubble generation chamber 11, and a supply channel 9 for supplying the bubble generation chamber 11 with ink. The ink-jet recording head also includes an element substrate 2 on which the heaters 1 are provided, and to a main surface of which the channel-configuration substrate is connected. The second discharge-port portion 10 is connected to the first discharge-port portion 4 and the bubble generation chamber 11 with respective steps. In a plan perspective view as seen from a direction perpendicular to the main surface of the element substrate 2, the periphery of the cross section of the second discharge-port portion 10 along a plane substantially parallel to the main surface of the element substrate 2 is outside of the periphery of the cross section of the discharge port in the same direction and inside the periphery of the cross section of the bubble generation chamber 11 in the same direction.

In the ink-jet recording head having the above-described configuration, the second discharge-port portion 10 has an end surface that includes a border portion with the first discharge-port portion 4 and is parallel to the main surface (a surface where the channel-configuration substrate is connected) of the element substrate 2. Any cross section of the second discharge-port portion 10, from an opening surface facing the bubble generation chamber 11 to the end surface facing the first discharge-port portion 4, that is parallel to the main surface of the element substrate 2, has an area that is larger than an area of the border portion (an opening surface of the first discharge-port portion 4 facing the second discharge-port portion 10). A cross section of the opening surface of the second discharge-port portion 10 facing the bubble generation chamber 11 that is parallel to the main surface of the element substrate 2 has a shape such that a length thereof in a direction perpendicular to a direction of arrangement of the discharge ports is larger than a length thereof in a direction parallel to the direction of arrangement of the discharge ports. By providing this second discharge-port portion 10, the entire fluid resistance in the direction of the discharge ports is reduced, and a bubble is grown while producing only a little pressure loss in the direction of the discharge ports. Accordingly, it is possible to suppress the flow rate in the direction of the channel, and thereby prevent reduction in the discharge speed of an ink droplet.

In order to reduce the amount of a discharged ink droplet (reduce the volume of the ink droplet), the size of the nozzle must be reduced. In this case, the fluid resistance of the supply channel greatly increases. As a result, the time required for refilling increases compared to the case in which the size of the nozzle is not reduced. By providing two ink supply channels facing across a heating resistor, it is possible to reduce the total fluid resistance of the ink supply channel, and shorten the time required for refilling. When thus intending to increase the refilling frequency, since it is advantageous to shorten the length in a direction perpendicular to the direction of arrangement of nozzles of the two supply channels having a relatively small area and a large fluid resistance where ink flows during refilling, the configuration of the present invention is preferable.

When providing a heater in which the length in a direction perpendicular to the direction of arrangement of the discharge ports is larger than the length in a direction parallel to the direction of arrangement of the discharge ports, the bubble pressure spreads in the direction perpendicular to the direction of arrangement of the discharge ports. Since the opening surface of the second discharge-port portion facing the bubble generation chamber is wide in the direction perpendicular to the direction of arrangement of the discharge ports, the bubble pressure that has spread can be sufficiently utilized as energy in the direction of ink discharge. Since the size of the second discharge-port portion can be adjusted according to the effective bubble area, the state of bubble generation can be more stabilized.

The structure of a nozzle of an ink-jet recording head, serving as a principal part of the present invention, will now be described illustrating various specific examples.

First Embodiment

Figure 2A:
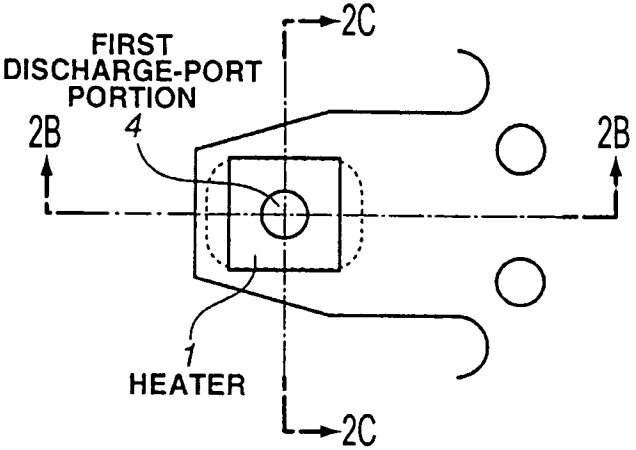
FIGS. 2A-2C are diagrams illustrating the structure of a nozzle of an ink-jet recording head according to a first embodiment of the present invention.
Figure 2B:
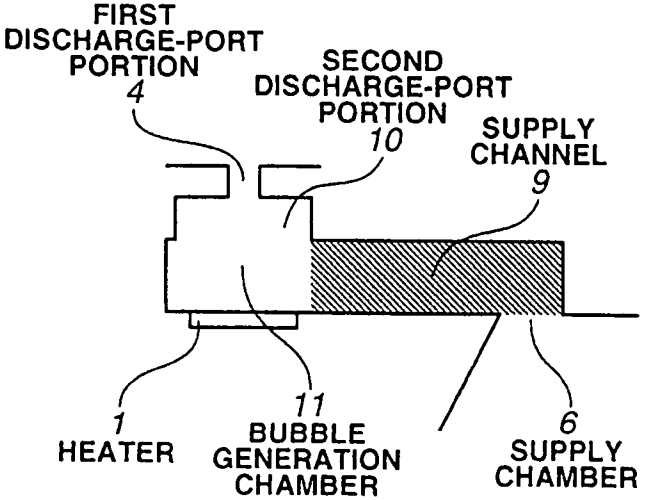
Figure 2C:
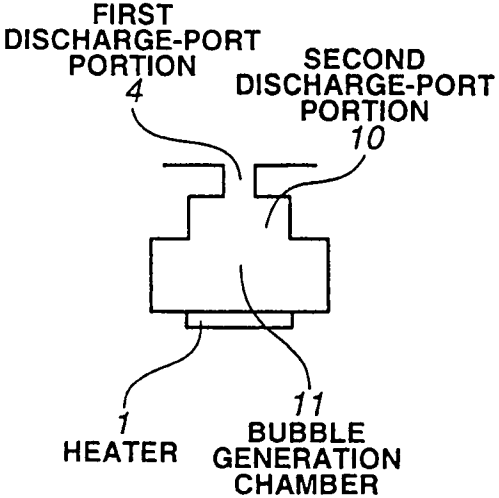

FIGS. 2A-2C illustrate the structure of a nozzle of an ink-jet recording head according to a first embodiment of the present invention. FIG. 2A is a plan perspective diagram in which one of a plurality of nozzles of the ink-jet recording head is seen from a direction perpendicular to a main surface (a surface where the channel-configuration substrate of the element substrate 2 is connected) of the element substrate 2; FIG. 2B is a cross-sectional view taken along line A-A shown in FIG. 2A; and FIG. 2C is a cross-sectional view taken along line B-B shown in FIG. 2A.

As shown in FIG. 1, the recording head having the nozzle structure of the first embodiment includes the element substrate 2 on which the plurality of heaters 1, each serving as an electrothermal transducer, are provided, and the channel-configuration substrate 3 that constitutes a plurality of ink channels by being connected to the main surface of the element substrate 2 in a laminated state.

The element substrate 2 is made of glass, ceramic, a resin, a metal, or the like. In general, the element substrate 2 is made of Si. On the main surface of the element substrate 2, the heater 1, electrodes (not shown) for applying a voltage to the heater 1, and wires (not shown) connected to the electrodes are provided for each of the ink channels with a predetermined wiring pattern. An insulating film (not shown) for improving the heat dispersion property is provided on the main surface of the element substrate 2 so as to cover the heaters 1. In addition, a protective film (not shown) for protecting the components from cavitation generated when a bubble disappears is provided so as to cover the insulating film.

As shown in FIG. 1, the channel configuration substrate 3 includes the plurality of nozzles 5 where ink flows, the supply chamber 6 for supplying the nozzles 5 with ink, and the plurality of first discharge-port portions 4, each serving as a distal-end opening of the corresponding nozzle 5 for discharging an ink droplet. The first discharge-port portions 4 are formed at positions facing the heaters 1 on the element substrate 2. As shown in FIGS. 2A-2C, each nozzle 5 has a first discharge-port portion 4 having a substantially constant diameter, a second discharge-port portion 10 for reducing the fluid resistance at the discharge port side, a bubble generation chamber 11, and a supply channel 9 (indicated by hatching in FIG. 2B). The bubble generation chamber 11 is formed on the heater 1 so that the base facing the opening surface of the first discharge-port portion 4 has a substantially rectangular shape. One end of the supply channel 9 communicates with the bubble generation chamber 11, and another end of the supply channel 9 communicates with the supply chamber 6. The supply channel 9 has a straight shape with a substantially constant width from the supply chamber 6 to the bubble generation chamber 11. The second discharge-port portion 10 is continuously formed above the bubble generation chamber 11. The nozzle 5 is formed such that the direction of discharge of an ink droplet from the first discharge-port portion 4 is orthogonal to the direction of flow of ink within the supply channel 9.

In the nozzle 5 shown in FIG. 1 that includes the first discharge-port portion 4, the second discharge-port portion 10, the bubble generation chamber 11 and the supply channel 9, the inner-wall surface facing the main surface of the element substrate 2 is parallel to the main surface of the element substrate 2 from the supply chamber 6 to the bubble generation chamber 11.

As is apparent from FIGS. 2A-2C, in the ink-jet recording head of the first embodiment, the second discharge-port portion 10 has an end surface that includes a border portion with the first discharge-port portion 4 and is parallel to the main surface (a surface where the channel-configuration substrate 3 is connected) of the element substrate 2. The area of the end surface of the second discharge-port portion 10 facing the first discharge-port portion 4 is larger than the area of the border portion (an opening surface of the first discharge-port portion 4 facing the second discharge-port portion 10). The cross section of the opening surface of the second discharge-port portion 10 facing the bubble generation chamber 11 that is parallel to the main surface of the element substrate 2 has a shape such that the length thereof in a direction perpendicular to a direction of arrangement of the first discharge-port portions 4 is larger than the length thereof in a direction parallel to the direction of arrangement of the discharge-port portions 4. In the second discharge-port portion 10, the end surface facing the first discharge-port portion 4 has the same cross section as the opening surface facing the bubble generation chamber 11. In FIG. 2A, a cross section obtained by cutting the second discharge-port portion 10 along a plane substantially parallel to the surface where the heater 1 is formed is substantially rectangular.

In order to transmit the bubble pressure to the first discharge-port portion 4 in a perpendicular direction as uniformly as possible, the second discharge-port portion 10 is made symmetrical with respect to the perpendicular drawn from the center of the first discharge-port portion 4 toward the main surface of the element substrate 2, to provide a well-balanced shape. The side wall of the second discharge-port portion 10 is represented by straight lines at any cross section passing through the center of the first discharge-port portion 4 and perpendicular to the main surface of the element substrate 2. The opening surfaces of the second discharge-port portion 10 facing the first discharge-port portion 4 and the bubble generation chamber 11, respectively, and the main surface of the element substrate 2 are substantially parallel.

Next, an operation of discharging an ink droplet from the first discharge-port portion 4 in the recording head having the above-described configuration will be described with reference to FIGS. 1, and 2A-2C.

First, ink supplied into the supply chamber 6 is supplied to the respective nozzles 5 of the first nozzle row 7 and the second nozzle row 8. The ink supplied to each of the nozzles 5 is filled into the bubble generation chamber 11 by flowing along the supply channel 9. The ink filled within the bubble generation chamber 11 is discharged from the first discharge-port portion 4 as an ink droplet by the pressure of a growing bubble generated by film boiling caused by the heater 1. When the ink filled within the bubble generation chamber 11 is discharged, part of the ink within the bubble generation chamber 11 flows toward the supply channel 9 by the pressure of the bubble generated within the bubble generation chamber 11. If a manner from bubble generation to ink discharge in the nozzle is locally seen, the pressure of the bubble generated within the bubble generation chamber 11 is also transmitted to the second discharge-port portion 10 instantaneously, and ink filled in the bubble generation chamber 11 and the second discharge-port portion 10 moves within the second discharge-port portion 10.

Figure 11A:
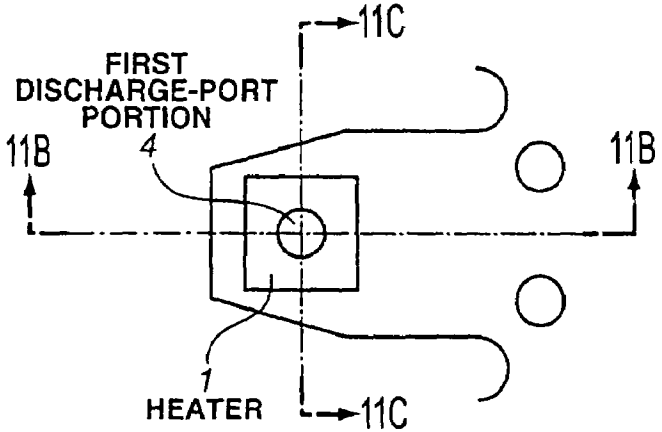
FIGS. 11A-11C are diagrams illustrating one of a plurality of nozzles of a conventional ink-jet print head.
Figure 11B:
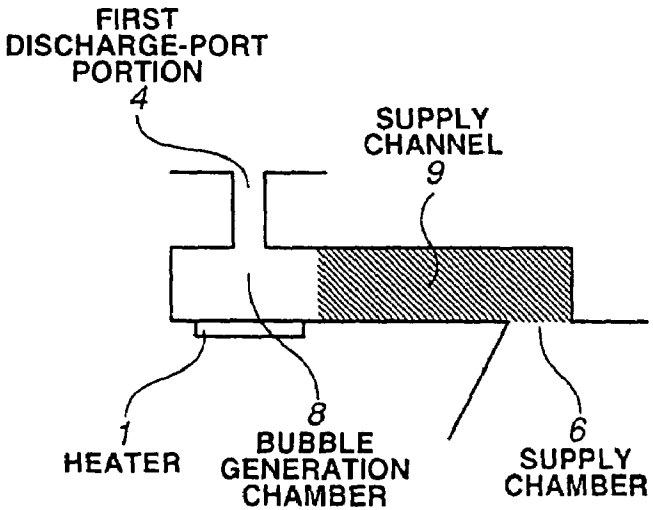
Figure 11C:
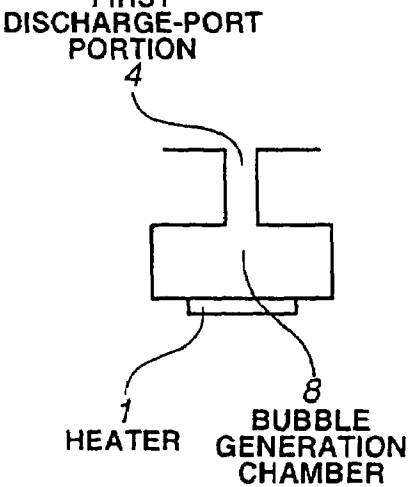

At that time, in the first embodiment, since the cross section of the second discharge-port portion 10 that is parallel to the main surface of the element substrate 2, i.e., the spatial volume, is larger than in the recording head shown in FIGS. 11A-11C that has only the cylindrical first discharge-port portion 4 as the discharge-port portion without having the second discharge-port portion 10, a pressure loss is very small, and ink is excellently discharged toward the first discharge-port portion 4. Accordingly, even if the fluid resistance in the direction of the discharge port at the discharge-port portion increases by further reducing the discharge port at the distal end of the nozzle, it is possible to suppress reduction of the flow rate in the direction of the discharge port, and thereby prevent a decrease in the discharge speed of the ink droplet.

Second Embodiment

In a second embodiment of the present invention, a nozzle structure is adopted in which the second discharge-port portion has a tapered shape in order to reduce stagnation of ink at the second discharge-port portion. Portions different from the first embodiment will now be mainly described with reference to FIGS. 3A-3C.

Figure 3A:
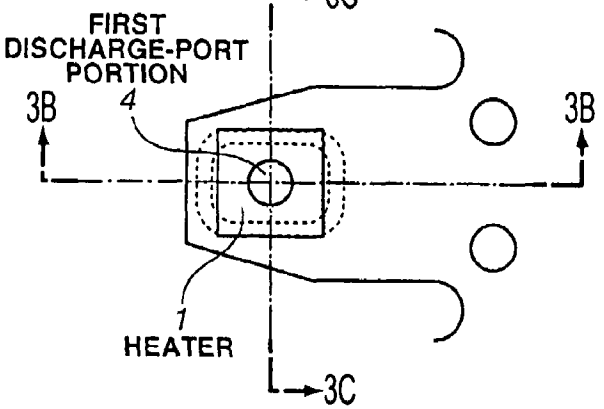
FIGS. 3A-3C are diagrams illustrating the structure of a nozzle of an ink-jet recording head according to a second embodiment of the present invention.
Figure 3B:
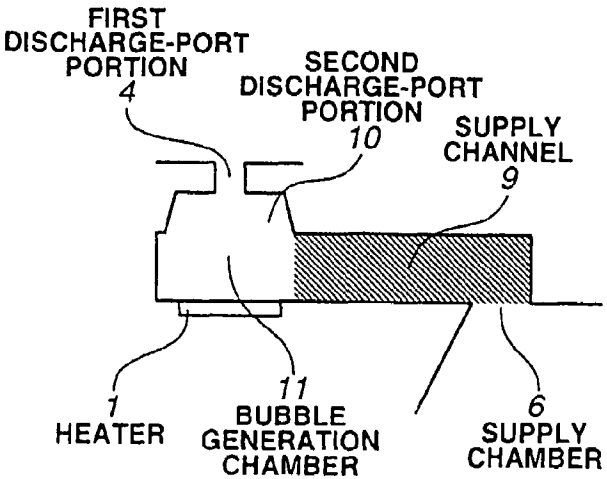
Figure 3C:
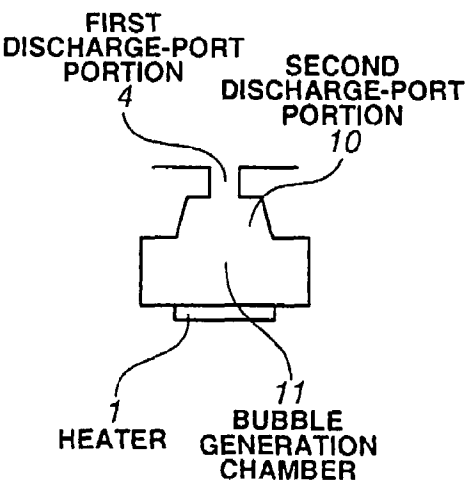

FIGS. 3A-3C illustrate the structure of a nozzle of an ink-jet recording head according to the second embodiment. FIG. 3A is a plan perspective diagram in which one of a plurality of nozzles of the ink-jet recording head is seen from a direction perpendicular to the main surface of the element substrate 2; FIG. 3B is a cross-sectional view taken along line A-A shown in FIG. 3A; and FIG. 3C is a cross-sectional view taken along line B-B shown in FIG. 3A.

As is apparent from FIGS. 3A-3C, as in the first embodiment, in the ink-jet recording head of the second embodiment, the second discharge-port portion 10 has an end surface that includes a border portion with the first discharge-port portion 4 and is parallel to the main surface (a surface where the channel-configuration substrate 3 is connected) of the element substrate 2. The area of the end surface of the second discharge-port portion 10 facing the first discharge-port portion 4 is larger than the area of the border portion (an opening surface of the first discharge-port portion 4 facing the second discharge-port portion 10). The cross section of the opening surface of the second discharge-port portion 10 facing the bubble generation chamber 11 that is parallel to the main surface of the element substrate 2 has a shape such that the length thereof in a direction perpendicular to a direction of arrangement of the first discharge-port portions 4 is longer than the length thereof in a direction parallel to the direction of arrangement of the discharge-port portions 4. In the second discharge-port portion 10, the end surface facing the discharge first discharge-port portion 4 is similar to and has a smaller cross section than the opening surface facing the bubble generation chamber 11. In FIG. 3A, a cross section obtained by cutting the second discharge-port portion 10 along a plane substantially parallel to the surface where the heater 1 is formed is substantially rectangular.

In the second embodiment, also, the cross section of the second discharge-port portion 10 parallel to the main surface of the element substrate 2, i.e., the spatial volume, is larger than the border portion between the first discharge-port portion 4 and the second discharge-port portion 10 compared with the recording head shown in FIGS. 11A-11C in which the discharge-port portion 4 within the nozzle is cylindrical, a pressure loss is very small, and ink is excellently discharged toward the first discharge-port portion 4. Accordingly, even if the fluid resistance in the direction of the discharge port at the first discharge-port portion 4 increases by further reducing the discharge port at the distal end of the nozzle, it is possible to suppress reduction of the flow rate in the direction of the discharge port, and thereby prevent a decrease in the discharge speed of the ink droplet.

Third Embodiment

An object of a third embodiment of the present invention is to reduce the region of ink stagnation in order to reduce variations in the discharge volume. In the second embodiment, the cross section of the second discharge-port portion is substantially rectangular. In the third embodiment, however, the cross section of the second discharge-port portion is elliptical.

Portions in the third embodiment that are different from the first embodiment will now be mainly described with reference to FIGS. 4A-4C.

Figure 4A:
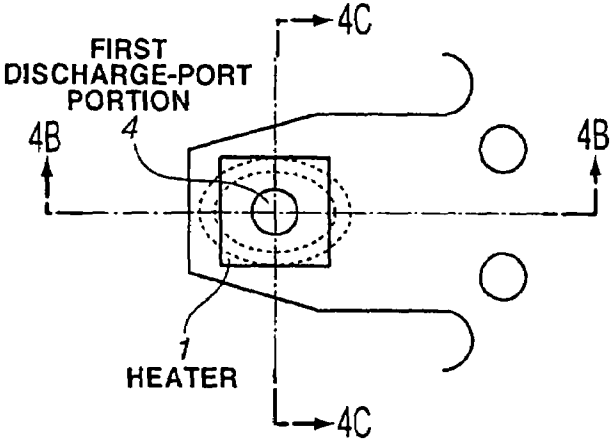
FIGS. 4A-4C are diagrams illustrating the structure of a nozzle of an ink-jet recording head according to a third embodiment of the present invention.
Figure 4B:
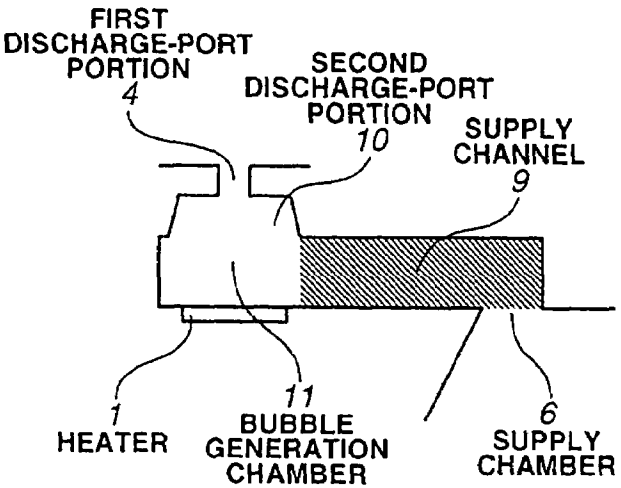
Figure 4C:
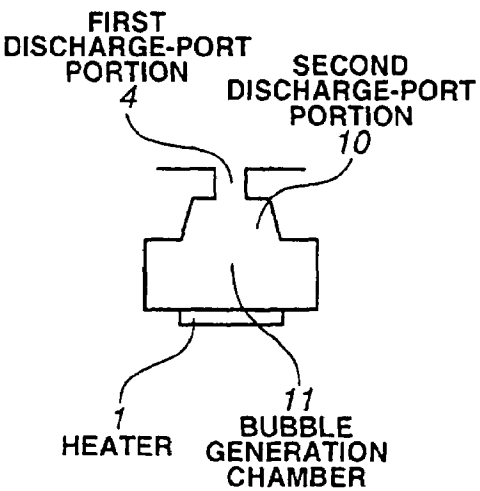

FIGS. 4A-4C illustrate the structure of a nozzle of an ink-jet recording head according to the third embodiment. FIG. 4A is a plan perspective diagram in which one of a plurality of nozzles of the ink-jet recording head is seen from a direction perpendicular to the main surface of the element substrate 2; FIG. 4B is a cross-sectional view taken along line A-A shown in FIG. 4A; and FIG. 4C is a cross-sectional view taken along line B-B shown in FIG. 4A.

As shown in the plan perspective diagram of FIG. 4A, the opening surface of the second discharge-port portion 10 facing the bubble generation chamber 11 is elliptic or oval and the diameter in a direction perpendicular to the direction of arrangement of the first discharge-port portions 4 is larger than the diameter in a direction parallel to the direction of arrangement of the first discharge-port portions 4. In the second discharge-port portion 10, the end surface facing the first discharge-port portion 4 is similar to and has a cross section having a smaller area than the opening surface facing the bubble generation chamber 11. By thus making the cross section obtained by cutting the second discharge-port portion 10 with a plane substantially parallel to the forming surface of the heater 1 an elliptic or oval shape, it is possible to remove a region of stagnation that occurs at the four corners when the cross section is rectangular.

In the third embodiment, by making the cross section of the second discharge-port portion 10 parallel to the main surface of the element substrate 2 elliptic or oval, the area thereof, is reduced by the area of the four corners. As a result, there is the possibility that the entire fluid resistance of the second discharge-port portion 10 increases. However, since the portion of the four corners is a portion of stagnation where ink does not flow, a fluid resistance equivalent to that in the first or second embodiment can be maintained.

In the third embodiment, when continuously discharging ink at a high frequency, since the cross section of the second discharge-port portion 10 parallel to the main surface of the element substrate 2 is smaller by the area of the four corners than in the first and second embodiments, the region of stagnation of ink is reduced, and variation in the volume of the discharged droplets is reduced.

In the third embodiment, also, the cross section of the second discharge-port portion 10 parallel to the main surface of the element substrate 2, i.e., the spatial volume, is larger than in the recording head shown in FIGS. 11A-11C in which the discharge-port portion 4 within the nozzle is cylindrical, a pressure loss is very small, and ink is excellently discharged toward the first discharge-port portion 4. Accordingly, even if the fluid resistance in the direction of the discharge port at the discharge-port portion 4 increases by further reducing the discharge port at the distal end of the nozzle, it is possible to suppress reduction of the flow rate in the direction of the discharge port, and thereby prevent a decrease in the discharge speed of the ink droplet.

Fourth Embodiment

An object of a fourth embodiment of the present invention is also to reduce the region of ink stagnation compared to the first embodiment, in order to reduce variation in the discharge volume. In addition, an object of a fourth embodiment of the present invention is further to eliminate unstable ink discharge due to deviation in a region of stagnation produced at a step portion between the first discharge-port portion 4 and the second discharge-port portion 10, by making the opening surface of the first discharge-port portion 4 facing the second discharge-port portion 10 and the end surface of the second discharge-port portion 10 facing the first discharge-port portion 4 concentric (in the form of a ring) with respect to a perpendicular drawn from the center of the first discharge-port portion 4 toward the main surface of the element substrate, 2.

Portions in the fourth embodiment that are different from the first embodiment will now be mainly described with reference to FIGS. 5A-5C.

Figure 5A:
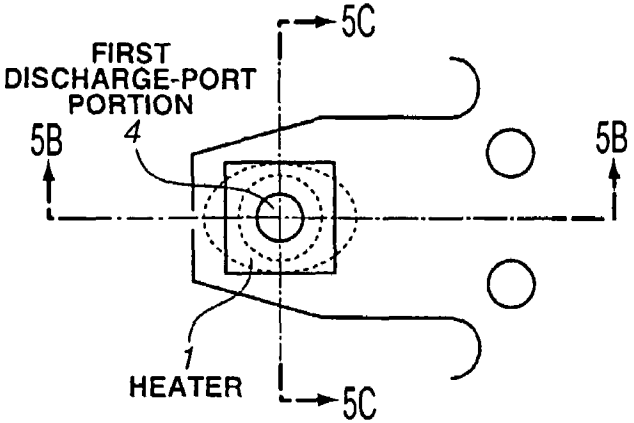
FIGS. 5A-5C are diagrams illustrating the structure of a nozzle of an ink-jet recording head according to a fourth embodiment of the present invention.
Figure 5B:
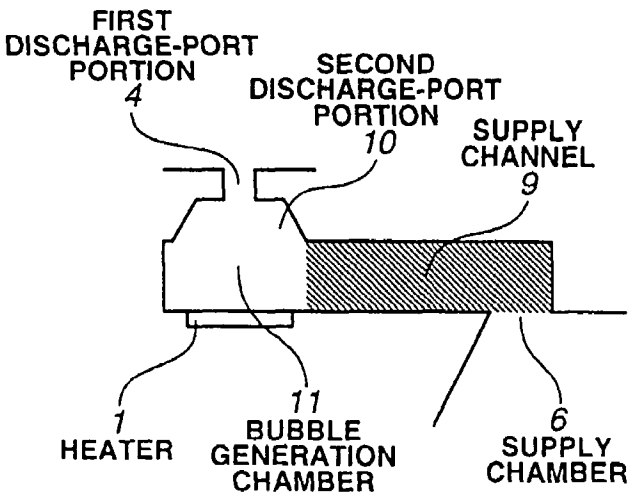
Figure 5C:
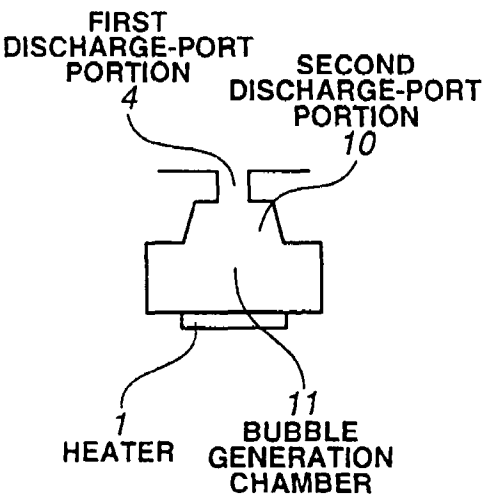

FIGS. 5A-5C illustrate the structure of a nozzle of an ink-jet recording head according to the fourth embodiment. FIG. 5A is a plan perspective diagram in which one of a plurality of nozzles of the ink-jet recording head is seen from a direction perpendicular to the main surface of the element substrate 2; FIG. 5B is a cross-sectional view taken along line A-A shown in FIG. 5A; and FIG. 5C is a cross-sectional view taken along line B-B shown in FIG. 5A.

As shown in the plan perspective diagram of FIG. 5A, the opening surface of the second discharge-port portion 10 facing the bubble generation chamber 11 is elliptic or oval and the diameter in a direction perpendicular to the direction of arrangement of the first discharge-port portions 4 is larger than the diameter in a direction parallel to the direction of arrangement of the first discharge-port portions 4. The periphery of the end surface of the second discharge-port portion 10 facing the first discharge-port portion 4 is circular, and is inside the periphery of the opening surface facing the bubble generation chamber 11. According to such a shape, since the opening surface of the first discharge-port portion 4 facing the second discharge-port portion 10 and the end surface of the second discharge-port portion 10 facing the first discharge-port portion 4 are formed to be concentric with respect to a perpendicular drawn from the center of the first discharge-port portion 4 toward the main surface of the element substrate 2, unstable ink discharge due to deviation in a region of stagnation produced at a step portion between the first discharge-port portion 4 and the second discharge-port portion 10 does not occur. In short, by forming the step portion between the second discharge-port portion 10 and the first discharge-port portion 4 symmetrically, the region of ink stagnation does not deviate over the entire step portion, and the discharge characteristics are stabilized compared with the above-described embodiments.

In the fourth embodiment, since the cross section of the second discharge-port portion 10 parallel to the main surface of the element substrate 2 is reduced, there is the possibility that the entire fluid resistance of the second discharge-port portion 10 increases compared with the first embodiment. However, since the step portion between the first discharge-port portion 4 and the second discharge-port portion 10 in the first embodiment is a portion of stagnation where ink does not flow, a fluid resistance equivalent to that in the first embodiment can be maintained.

In the fourth embodiment, also, the cross section of the second discharge-port portion 10 parallel to the main surface of the element substrate 2, i.e., the spatial volume, is larger than in the recording head shown in FIGS. 11A-11C in which the discharge-port portion 4 within the nozzle is cylindrical, a pressure loss is very small, and ink is excellently discharged toward the first discharge-port portion 4. Accordingly, even if the fluid resistance in the direction of the discharge port at the first discharge-port portion 4 increases by further reducing the discharge port at the distal end of the nozzle, it is possible to suppress reduction of the flow rate in the direction of the discharge port, and thereby prevent a decrease in the discharge speed of the ink droplet.

In the fourth embodiment, also, by making the length of the opening surface of the second discharge-port portion 10 facing the bubble generation chamber 11 in a direction perpendicular to the direction of arrangement of the discharge ports longer than the length in a direction parallel to the direction of arrangement of the discharge ports, it is possible to increase the cross section of the second discharge-port portion 10 without being limited by the width of the bubble generation chamber 11 even if the width is reduced in accordance with reduction in the size of the ink droplet. Hence, it is possible to further reduce the entire fluid resistance in the direction of the discharge ports.

Fifth Embodiment

In a fifth embodiment of the present invention, by providing a sub-supply channel, the total fluid resistance in the two supply channels (the supply channel 9 and a sub-supply channel 12) is reduced to allow refilling processing at a high frequency. Portions in the fifth embodiment that are different from the first embodiment will now be mainly described with reference to FIGS. 6A-6C.

Figure 6A:
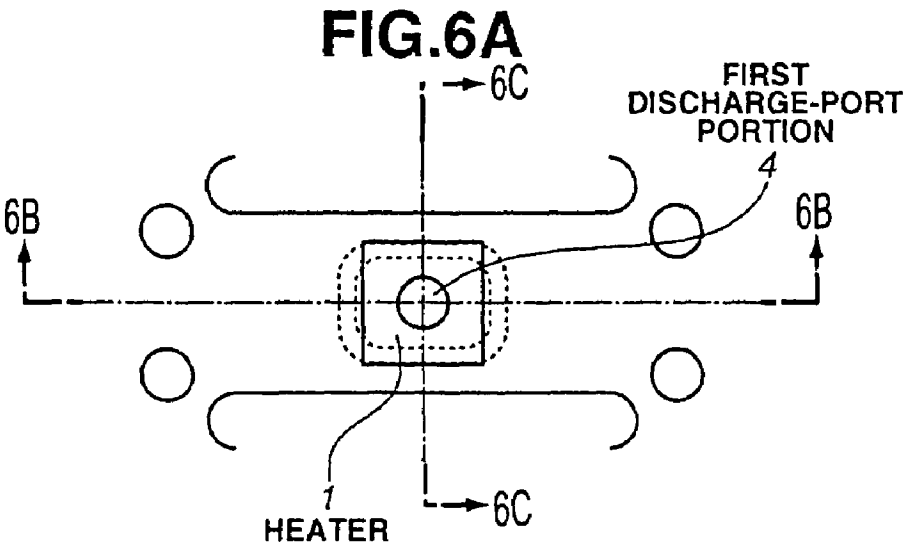
FIGS. 6A-6C are diagrams illustrating the structure of a nozzle of an ink-jet recording head according to a fifth embodiment of the present invention.
Figure 6B:
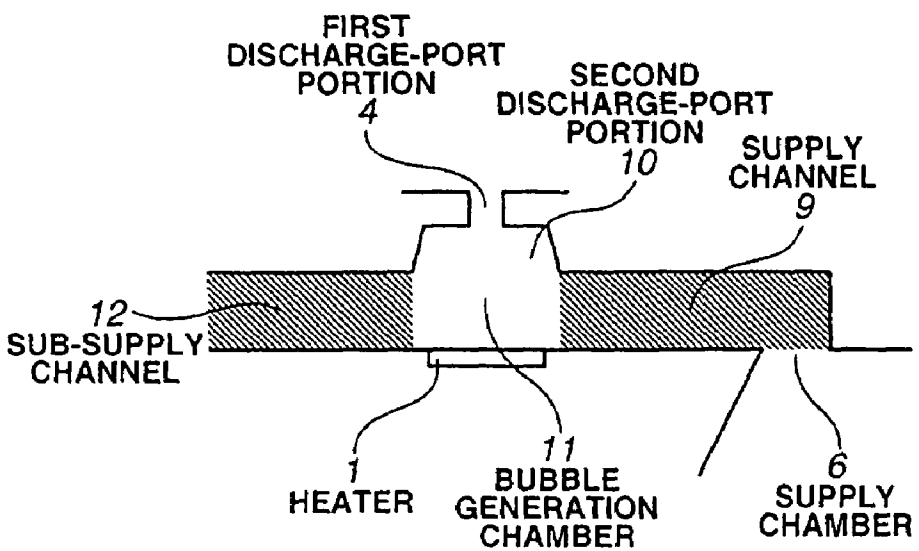
Figure 6C:
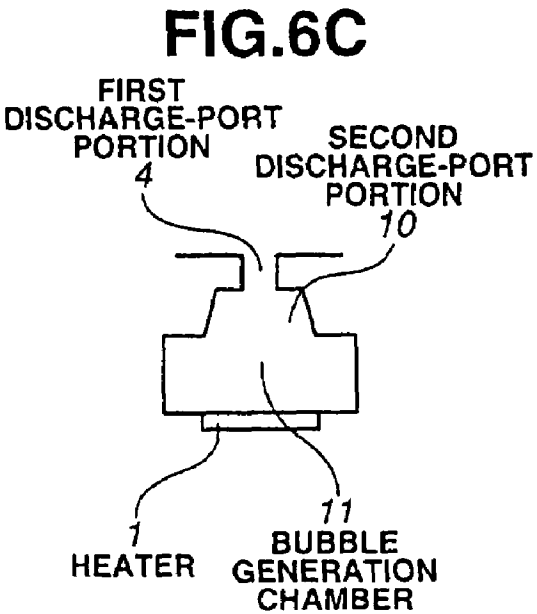

FIGS. 6A-6C illustrate the structure of a nozzle of an ink-jet recording head according to the fifth embodiment. FIG. 6A is a plan perspective diagram in which one of a plurality of nozzles of the ink-jet recording head is seen from a direction perpendicular to the main surface of the element substrate 2; FIG. 6B is a cross-sectional view taken along line A-A shown in FIG. 6A; and FIG. 6C is a cross-sectional view taken along line B-B shown in FIG. 6A.

As shown in the plan perspective diagram of FIG. 6A, the opening surface of the second discharge-port portion 10 facing the bubble generation chamber 11 has a shape such that the length in a direction perpendicular to the direction of arrangement of the first discharge-port portion 4 is larger than the length in a direction parallel to the direction of arrangement of the first discharge-port portion 4. In the second discharge-port portion 10, the end surface facing the first discharge-port portion 4 is similar to and has a cross section having a smaller area than the opening surface facing the bubble generation chamber 11. In FIG. 6A, the cross section obtained by cutting the second discharge-port portion 10 with a plane substantially parallel to the forming surface of the heater 1 is substantially rectangular.

In order to realize refilling at a high frequency, a sub-ink supply channel 12 is provided in addition to the ink supply channel 9.

Next, an operation of discharging an ink droplet from the first discharge-port portion 4 in the recording head having the above-described configuration will be described with reference to FIGS. 1 and 6A-6C.

First, ink supplied into the supply chamber 6 is supplied to the respective nozzles 5 of the first nozzle row 7 and the second nozzle row 8. The ink supplied to each of the nozzles 5 is filled into the bubble generation chamber 11 by flowing along the supply channel 9. The ink filled within the bubble generation chamber 11 is discharged from the first discharge-port portion 4 as an ink droplet by the pressure of a growing bubble generated by film boiling caused by the heater 1. When the ink filled within the bubble generation chamber 11 is discharged, part of the ink within the bubble generation chamber 11 flows toward the supply channel 6 and the sub-supply channel 12 by the pressure of the bubble generated within the bubble generation chamber 11. If a manner from bubble generation to ink discharge in the nozzle is locally seen, the pressure of the bubble generated within the bubble generation chamber 11 is also transmitted to the second discharge-port portion 10 instantaneously, and ink filled in the bubble generation chamber 11 and the second discharge-port portion 10 moves within the second discharge-port portion 10.

At that time, in the fifth embodiment, the cross section of the second discharge-port portion 10 parallel to the main surface of the element substrate 2, i.e., the spatial volume, is larger than in the recording head shown in FIGS. 11A-11C in which the first discharge-port portion 4 within the nozzle is cylindrical, a pressure loss is very small, and ink is excellently discharged toward the first discharge-port portion 4. Accordingly, even if the fluid resistance in the direction of the discharge port at the first discharge-port portion 4 increases by further reducing the discharge port at the distal end of the nozzle, it is possible to suppress reduction of the flow rate in the direction of the discharge port, and thereby prevent a decrease in the discharge speed of the ink droplet.

In the fifth embodiment, in order to deal with reduction in the amount of a discharged ink droplet (provision of a small ink droplet), by providing two supply channels, the total fluid resistance at the two supply channels is reduced, thereby allowing refilling at a high frequency. In the fifth embodiment, the opening surface of the second discharge-port portion 10 facing the bubble generation chamber 11 is increased by making the length thereof in a direction perpendicular to the direction of arrangement of the discharge ports larger than the length thereof in a direction parallel to the direction of arrangement of the discharge ports, and the lengths of the two supply channels (i.e., the supply channel 9 and the sub-supply channel 12) having a fluid resistance larger than in the second discharge-port portion 10 in a direction perpendicular to the direction of arrangement of the nozzles (i.e., the direction of ink supply) are shortened. As a result, it is possible to reduce the fluid resistance of the total supply path from the supply port 6 to the discharge port, and thereby provide a higher refilling frequency.

Sixth Embodiment

Since the size of the discharge port must be reduced in order to reduce the amount of a discharged ink droplet (reduce the volume of the discharged ink droplet), the fluid resistance in the direction of the discharge port is greatly increased. In order to solve this problem, as described above, the discharge efficiency is improved by providing a second discharge-port portion having a small fluid resistance. In another approach, the energy of the heater, i.e., the area of the heater, may be increased. However, in accordance with the reduction of the volume of the discharged ink droplets and of the diameter of the printed dots, the nozzle arrangement density must be increased. Since the size of the nozzles is small in a direction parallel to the direction of arrangement of the nozzles, the size of the heater cannot be increased in the direction of arrangement of the nozzles such that the length of the heater in the direction of arrangement of discharge ports is substantially equal to the length of the opening surface of the second discharge-port portion facing the bubble generation chamber in this direction. Accordingly, in a sixth embodiment of the present invention, a heater (a longitudinal heater) is provided the length of which in a direction perpendicular to the direction of arrangement of discharge ports is larger than the length of which in a direction parallel to the direction of arrangement of the discharge ports. In order to realize energy savings, it is necessary to output discharge energy equivalent to the current energy value using a small current. For that purpose, the heater must have a high electric resistance. The longitudinal heater is suitable for this purpose because this heater is long in the direction of wiring (not shown). In the sixth embodiment having such a longitudinal heater, the bubble pressure spreads in a direction perpendicular to the direction of arrangement of the discharge ports. However, since the opening surface of the second discharge-port portion facing the bubble generation chamber is large in a direction perpendicular to the direction of arrangement of the discharge ports, even the bubble pressure that has so spread can be sufficiently utilized as energy in a direction of ink discharge. Portions in the sixth embodiment that are different from the first embodiment will now be mainly described with reference to FIGS. 7A-7C.

Figure 7A:
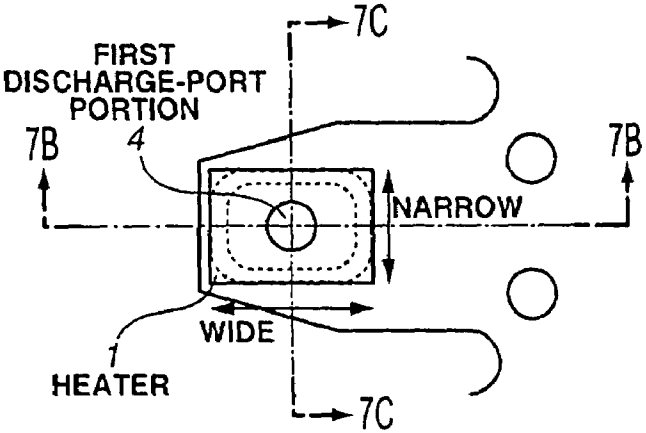
FIGS. 7A-7C are diagrams illustrating the structure of a nozzle of an ink-jet recording head according to a sixth embodiment of the present invention.
Figure 7B:
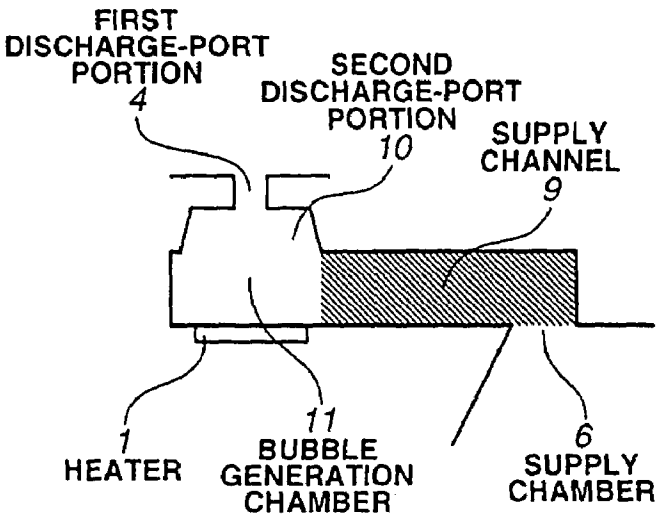
Figure 7C:
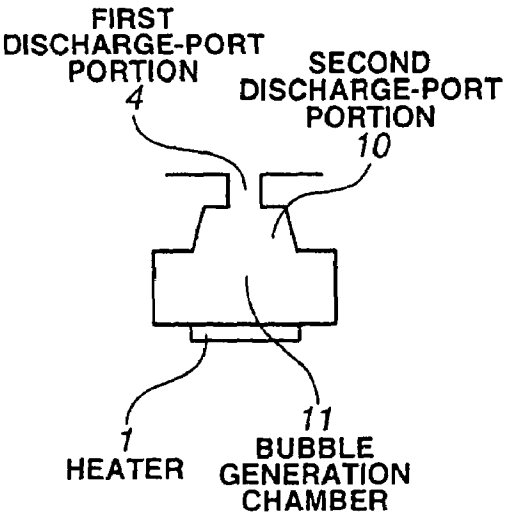

FIGS. 7A-7C illustrate the structure of a nozzle of an ink-jet recording head according to the sixth embodiment. FIG. 7A is a plan perspective diagram in which one of a plurality of nozzles of the ink-jet recording head is seen from a direction perpendicular to the main surface of the element substrate 2; FIG. 7B is a cross-sectional view taken along line A-A shown in FIG. 7A; and FIG. 7C is a cross-sectional view taken along line B-B shown in FIG. 7A.

As shown in the plan perspective diagram of FIG. 7A, a cross section of the second discharge-port portion 10, at any point from the opening surface facing the bubble generation chamber 11 to the end surface facing the first discharge-port portion 4, that is parallel to the main surface of the element substrate 2, has a shape such that the length thereof in a direction perpendicular to the direction of arrangement of the first discharge-port portions 4 is larger than the length thereof in a direction parallel to the direction of arrangement of the first discharge-port portions 4. In the second discharge-port portion 10, the opening surface facing the first discharge-port portion 4 is similar to and has a cross section having a smaller area than the opening surface facing the bubble generation chamber 11. In FIG. 7A, the cross section obtained by cutting the second discharge-port portion 10 with a plane substantially parallel to the forming surface of the heater 1 is substantially rectangular.

In the sixth embodiment, a heater 1 is provided having a rectangular shape the length of which in a direction perpendicular to the direction of arrangement of the discharge ports is greater than the length of which in a direction parallel to the direction of arrangement of the discharge ports. In such a case, the bubble pressure due to the thermal energy generated by the heater spreads in a direction perpendicular to the direction of arrangement of the discharge ports. However, since the opening surface of the second discharge-port portion facing the bubble generation chamber is large in a direction perpendicular to the direction of arrangement of the discharge ports, even the bubble pressure that has so spread can be sufficiently utilized as energy in a direction of ink discharge.

In the sixth embodiment, the opening surface of the second discharge-port portion facing the bubble generation chamber is provided at a position facing the heater, with a rectangular shape that is substantially the same as the shape of the heater.

Since a region of the heater to about 4 μm from the edge of the heater does not contribute to bubble generation, the opening surface of the second discharge-port portion facing the first discharge-port portion may have a shape identical to the shape of the effective bubble generation region that contributes to bubble generation. Even if the heater is more or less larger than the opening surface of the second discharge-port portion facing the first discharge-port portion by taking into consideration the effective bubble generation region, the opening surface of the second discharge-port portion facing the bubble generation chamber is assumed to have a shape substantially identical to the shape of the heater.

In the sixth embodiment, also, by making the length of the opening surface of the second discharge-port portion 10 facing the bubble generation chamber 11 in a direction perpendicular to the direction of arrangement of the discharge ports longer than the length thereof in a direction parallel to the direction of arrangement of the discharge ports, it is possible to increase the cross section of the second discharge-port portion 10 without being limited by the width of the bubble generation chamber 11 even if the width is reduced in order to provide a small ink droplet. Hence, it is possible to further reduce the entire fluid resistance in the direction of the discharge ports.

Other Embodiments

Each of the above-described embodiments may be applied to the following embodiments.

Figure 8:
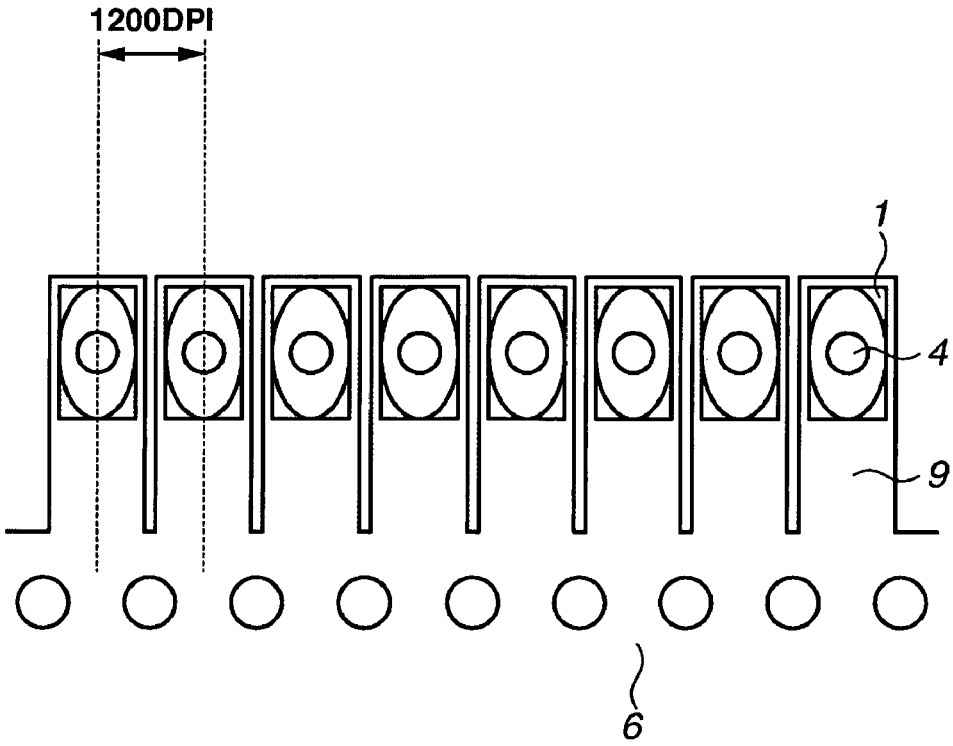
FIG. 8 is a diagram illustrating the structure of a nozzle of an ink-jet recording head according to still another embodiment of the present invention.
Figure 9:
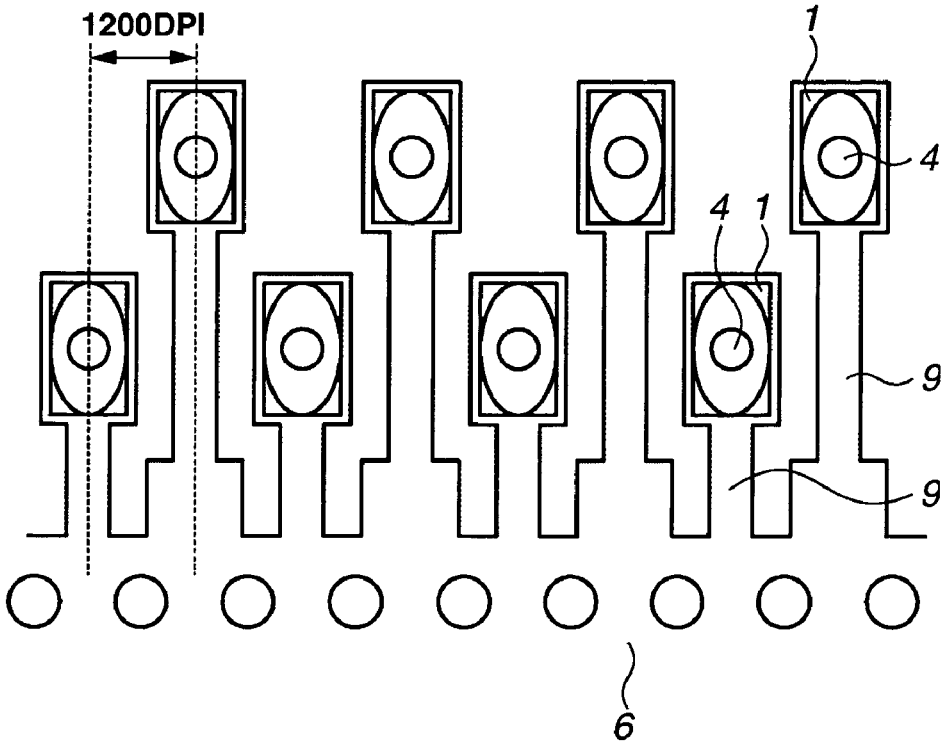
FIG. 9 is a diagram illustrating the structure of a nozzle of an ink-jet recording head according to still a further embodiment of the present invention.

Each of FIGS. 8 and 9 illustrates the arrangement of a plurality of nozzles of the above-described ink-jet recording head. In FIGS. 8 and 9, a plurality of discharge ports are arranged along the supply chamber 6 with a pitch of 1,200 dpi. By applying the nozzles of the above-described embodiments to these ink-jet recording heads, and adopting a configuration in which the cross section of the second discharge-port portion 10, at any point from the opening surface facing the bubble generation chamber to the end surface facing the first discharge-port portion, that is parallel to the main surface of the electron substrate 2, has a shape such that the length thereof in a direction perpendicular to the direction of arrangement of the discharge ports is larger than the length thereof in a direction parallel to the direction of arrangement of the discharge ports, it is possible to reduce the fluid resistance in the direction of the discharge ports without hindering high-density arrangement of the discharge ports, and to provide a very precise recorded image by suppressing a decrease in the ink discharge speed due to provision of small ink droplets by increasing the volume of the second discharge-port portion while realizing high-density arrangement of discharge ports.

In order to increase the volume of the second discharge-port portion while realizing a high-density arrangement of discharge ports, in each of the nozzles of the above-described embodiments, it is preferable to provide a configuration in which the cross section of each of the first discharge-port portion 4 and the second discharge-port portion 10 at the end surface of the second discharge-port portion 10 facing the first discharge-port portion 4 has a shape such that the ratio of the length of the second discharge-port portion 10 to the length of the first discharge-port portion 4 in a direction perpendicular to the direction of arrangement of the discharge ports is larger than the ratio of the length of the second discharge-port portion 10 to the length of the first discharge-port portion 4 in a direction parallel to the direction of arrangement of the discharge ports.

Furthermore, as shown in FIG. 9, by arranging a plurality of nozzles in a staggered shape, it is possible to improve the adhesive property between the channel-configuration substrate and the element substrate by increasing the width of the wall between adjacent nozzles.

Figure 10:
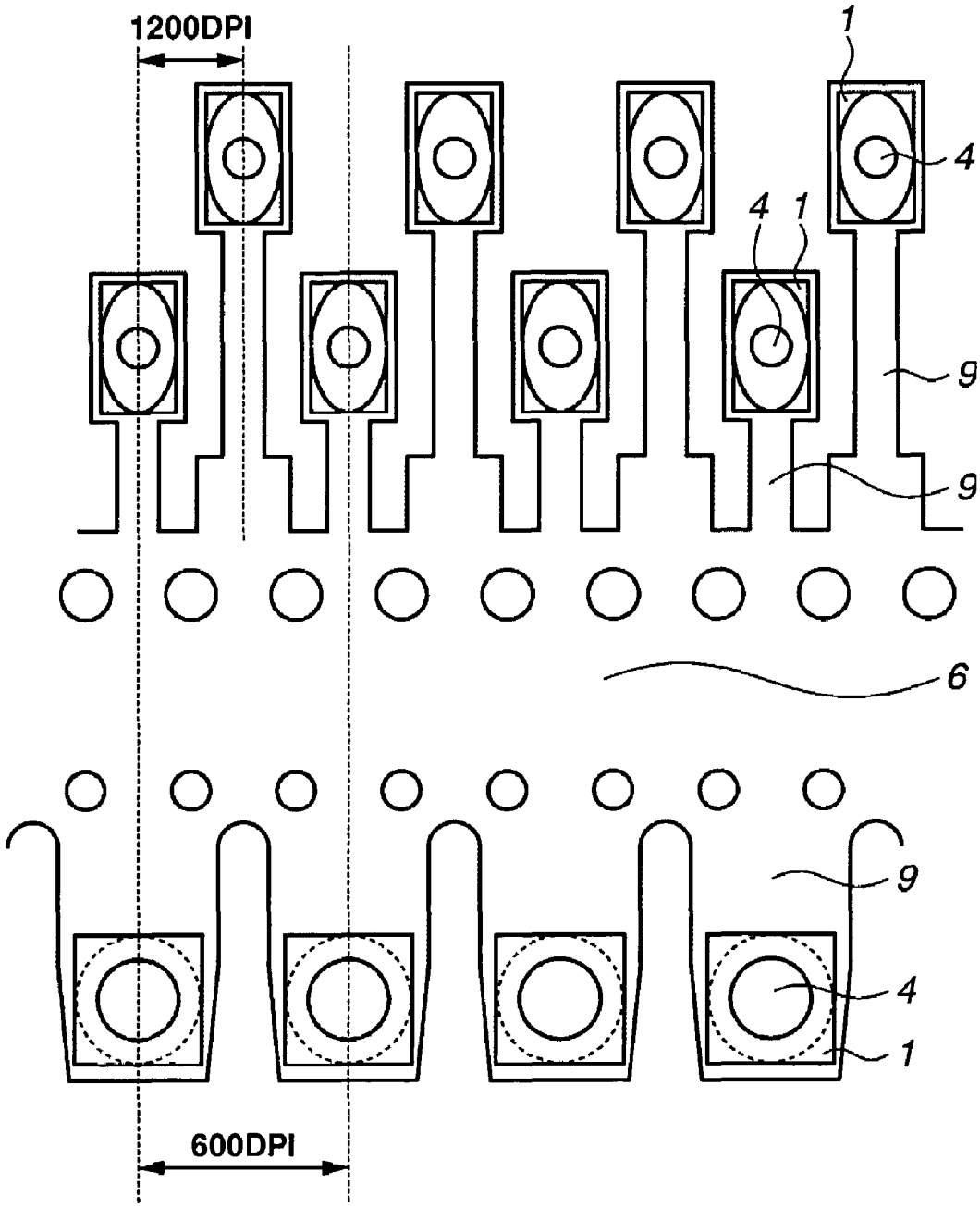
FIG. 10 is a diagram illustrating the structure of a nozzle of an ink-jet recording head according to yet a further embodiment of the present invention.

Each of the above-described embodiments may also be applied to an ink-jet recording head for discharging a plurality of ink droplets having different volumes. In such a case, as shown in FIG. 10, it is preferable to apply the configuration of each of the above-described embodiments to a nozzle for discharging an ink droplet having a relatively small volume. However, the configuration of each of the above-described embodiments may also be applied to a nozzle for discharging an ink droplet having a relatively large volume.

The individual components shown in outline in the drawings are all well-known in the ink-jet recording head arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid ejection head comprising:

a substrate on which a plurality of electrothermal transducers for generating energy for ejecting liquid droplets are provided;

a plurality of chambers having said electrothermal transducers, respectively, wherein a bottom face in the interior of each of said chambers has a rectangular shape;

at least one supply path for supplying said chambers with liquid;

a supply port for supplying said supply path with liquid;

a plurality of ejection ports each facing a surface on which a corresponding one of said electrothermal transducers is disposed; and a plurality of ejection portions having said ejection ports, respectively, entire circumferences of said ejection portions being surrounded by a wall, wherein each of said ejection portions comprises a first portion communicating with a corresponding one of said ejection ports and a second portion communicating with said first portion and a corresponding one of said chambers, wherein $A_c > A_{e2} > A_{e1}$, where $A_c$=a cross-sectional area of said corresponding chamber, the cross-sectional area being parallel to a surface on which a corresponding one of said electrothermal transducers is disposed, $A_{e2}$=a cross-sectional area of said second portion, the cross-sectional area being parallel to the surface on which said corresponding electrothermal transducer is disposed, and $A_{e1}$=a cross-sectional area of said first portion, the cross-sectional area being parallel to the surface on which said corresponding electrothermal transducer is disposed, wherein a length of an opening shape of said second portion facing said corresponding chamber in a direction parallel to a direction of said supply path is longer than a length of the opening shape of said second portion facing said corresponding chamber in a direction perpendicular to the direction of said supply path, wherein a surface of said second portion facing said corresponding chamber, a surface of said second portion facing said first portion, and a cross-section of said second portion parallel to said substrate are oval, and wherein lengths of said electrothermal transducers and lengths of said chambers in the direction of said supply path are longer than lengths of said electrothermal transducers and lengths of said chambers in the direction perpendicular to the direction of said supply path.

2. A liquid ejection head comprising:

a substrate on which a plurality of electrothermal transducers for generating energy for ejecting liquid droplets are provided;

a plurality of chambers, three sides of the respective chambers being surrounded by a wall and having said electrothermal transducers, respectively, wherein a bottom face in the interior of each of said chambers has a rectangular shape;

at least one supply path for supplying said chambers with liquid;

a supply port for supplying said supply path with liquid;

a plurality of ejection ports each facing a surface on which a corresponding one of said electrothermal transducers is disposed; and a plurality of ejection portions having said ejection ports, respectively, entire circumferences of said ejection portions being surrounded by a wall, wherein each of said ejection portions comprises a first portion communicating with a corresponding one of said ejection ports and a second portion communicating with said first portion and a corresponding one of said chambers, wherein $A_c>A_{e2}>A_{e1}$, where $A_c$=a cross-sectional area of said corresponding chamber, the cross-sectional area being parallel to a surface on which a corresponding one of said electrothermal transducers is disposed, $A_{e2}$=a cross-sectional area of said second portion, the cross-sectional area being parallel to the surface on which said corresponding electrothermal transducer is disposed, and $A_{e1}$=a cross-sectional area of said first portion, the cross-sectional area being parallel to the surface on which said corresponding electrothermal transducer is disposed, wherein a length of an opening shape of said second portion facing said corresponding chamber in a direction parallel to a direction of said supply path is longer than a length of the opening shape of said second portion facing said corresponding chamber in a direction perpendicular to the direction of said supply path, wherein a surface of said second portion facing said corresponding chamber, a surface of said second portion facing said first portion, and a cross-section of said second portion parallel to said substrate are oval, and wherein lengths of said electrothermal transducers and lengths of said chambers in the direction of said supply path are longer than lengths of said electrothermal transducers and lengths of said chambers in the direction perpendicular to the direction of said supply path.

3. A liquid ejection head comprising:

a substrate on which a plurality of electrothermal transducers for generating energy for ejecting liquid droplets are provided;

a plurality of chambers having said electrothermal transducers;

at least one supply path for supplying said chambers with liquid;

a supply port for supplying said supply path with liquid;

a plurality of ejection ports each facing a surface on which a corresponding one of said electrothermal transducers is disposed; and a plurality of ejection portions having said ejection ports, respectively, entire circumferences of said ejection portions being surrounded by a wall, wherein each of said ejection portions comprises a first portion communicating with a corresponding one of said ejection ports and a second portion communicating with said first portion and a corresponding one of said chambers, wherein $A_c>A_{e2}>A_{e1}$, where $A_c$=a cross-sectional area of said corresponding chamber, the cross-sectional area being parallel to a surface on which a corresponding one of said electrothermal transducers is disposed, $A_{e2}$=a cross-sectional area of said second portion, the cross-sectional area being parallel to the surface on which said corresponding electrothermal transducer is disposed, and $A_{e1}$=a cross-sectional area of said first portion, the cross-sectional area being parallel to the surface on which said corresponding electrothermal transducer is disposed, wherein a length of an opening shape of said second portion facing said corresponding chamber in a direction parallel to a direction of said supply path is longer than a length of the opening shape of said second portion facing said corresponding chamber in a direction perpendicular to the direction of said supply path, wherein a surface of said second portion facing said corresponding chamber, a surface of said second portion facing said first portion, and a cross-section of said second portion parallel to said substrate are oval, and wherein the lengths of said electrothermal transducers in the direction of said supply path are longer than the lengths of said electrothermal transducers in the direction perpendicular to the direction of said supply path.

4. A liquid ejection head of claim 3, wherein a bottom face in the interior of each of said chambers has a rectangular shape, and wherein lengths of said chambers in the direction of said supply path are longer than lengths of said chambers in the direction perpendicular to the direction of said supply path.

* * * * *